US007029400B2

(12) United States Patent
Briggs

(10) Patent No.: US 7,029,400 B2
(45) Date of Patent: Apr. 18, 2006

(54) INTERACTIVE WATER ATTRACTION AND QUEST GAME

(75) Inventor: Rick A. Briggs, Springfield, IL (US)

(73) Assignee: Creative Kingdoms, LLC, Wakefield, RI (US)

( * ) Notice: Subject to any disclaimer, the term of this patent is extended or adjusted under 35 U.S.C. 154(b) by 0 days.

(21) Appl. No.: 10/632,556

(22) Filed: Aug. 1, 2003

(65) Prior Publication Data

US 2004/0198517 A1 Oct. 7, 2004

Related U.S. Application Data

(60) Provisional application No. 60/400,430, filed on Aug. 1, 2002.

(51) Int. Cl.
*A63H 23/10* (2006.01)

(52) U.S. Cl. ..... 472/128; 472/137

(58) Field of Classification Search ..... 472/116, 472/117, 128, 129, 137; 273/440; 463/1, 463/40–43

See application file for complete search history.

(56) References Cited

U.S. PATENT DOCUMENTS

| | | | |
|---|---|---|---|
| 3,395,920 | A | 8/1968 | Moe |
| 3,707,055 | A | 12/1972 | Pearce |
| 3,997,156 | A | 12/1976 | Barlow et al. |
| 4,063,111 | A | 12/1977 | Dobler |
| 4,282,681 | A | 8/1981 | McCaslin |
| 4,296,929 | A | 10/1981 | Meyer et al. |
| 4,412,205 | A | 10/1983 | Von Kemenczky |
| 4,678,450 | A | 7/1987 | Scolari et al. |
| 4,858,930 | A | 8/1989 | Sato |
| 4,891,032 | A | 1/1990 | Davis |
| 4,967,321 | A | 10/1990 | Cimock |
| 5,036,442 | A | 7/1991 | Brown |
| 5,114,155 | A | 5/1992 | Tillery et al. |
| 5,114,344 | A | 5/1992 | Fumagalli et al. |

(Continued)

FOREIGN PATENT DOCUMENTS

WO PCT/US97/01811 6/1997

(Continued)

OTHER PUBLICATIONS

Pajama Sam: No Need To Hide When It's Dark Outside Infogames, Sept. 6, 2002.

(Continued)

*Primary Examiner*—Kien Nguyen
(74) *Attorney, Agent, or Firm*—Knobbe, Martens, Olson & Bear, LLP

(57) ABSTRACT

An interactive water attraction and system of game play is provided wherein the gaming is carried out within a pool, water park or water attraction. The game utilizes electronically identifiable objects, cards, bands, tags and/or the like, to provide an interactive game play experience generally simulative of a computer adventure game experience. Play participants are challenged to work and cooperate with other play participants to find identified objects, clues or other information and to use the objects, clues or information to solve various puzzles or problems that present encumbrances inhibiting players' advancement in the game. Each play participant possesses a unique RFID band, card or the like, that electronically identifies the play participant and enables the play system to award and track points or other rewards to successful play participants individually or working with other play participants as a team. The game in accordance with the invention provides the intellectual challenge and excitement of a computer adventure game, but with tangible interactives, physical challenges, and social interaction.

27 Claims, 5 Drawing Sheets

U.S. PATENT DOCUMENTS 5,194,048 A 3/1993 Briggs
5,236,200 A 8/1993 McGregor et al.
5,320,358 A 6/1994 Jones
5,356,343 A 10/1994 Lovetere
5,365,214 A 11/1994 Angott et al.
5,378,197 A 1/1995 Briggs
5,382,026 A 1/1995 Harvard et al.
5,411,269 A 5/1995 Thomas
5,482,510 A 1/1996 Ishii et al.
5,498,002 A 3/1996 Gechter
5,550,721 A 8/1996 Rapisarda
5,580,319 A 12/1996 Hamilton
5,587,740 A 12/1996 Brennan
5,651,049 A 7/1997 Easterling et al.
5,655,053 A 8/1997 Renie
5,674,128 A 10/1997 Holch et al.
5,751,273 A 5/1998 Cohen
5,757,305 A 5/1998 Xydis
5,785,592 A 7/1998 Jacobsen
5,786,626 A 7/1998 Brady et al.
5,810,666 A 9/1998 Mero et al.
5,811,896 A 9/1998 Grad
5,830,065 A 11/1998 Sitrick
5,835,576 A 11/1998 Katz
5,836,817 A 11/1998 Acres et al.
5,851,149 A 12/1998 Xidos et al.
5,853,332 A 12/1998 Briggs
5,855,483 A 1/1999 Collins et al.
5,865,680 A 2/1999 Briggs
5,924,695 A 7/1999 Heykoop
5,942,969 A 8/1999 Wicks
5,944,533 A 8/1999 Wood
5,946,444 A 8/1999 Evans et al.
5,963,136 A * 10/1999 O'Brien ..... 340/573.1
5,964,660 A 10/1999 James et al.
5,996,033 A 11/1999 Chiu-Hao
6,009,458 A 12/1999 Hawkins et al.
6,012,984 A 1/2000 Roseman
6,025,830 A 2/2000 Cohen
6,075,443 A 6/2000 Schepps et al.
6,129,549 A 10/2000 Thompson
6,150,947 A 11/2000 Shima
6,162,123 A 12/2000 Woolston
6,196,893 B1 3/2001 Casola et al.
6,200,216 B1 3/2001 Peppel
6,210,287 B1 4/2001 Briggs
6,220,965 B1 4/2001 Hanna et al.
6,234,803 B1 5/2001 Watkins
RE37,220 E 6/2001 Rapisarda et al.
6,254,101 B1 7/2001 Young
6,273,425 B1 8/2001 Westfall et al.
6,283,871 B1 9/2001 Briggs
6,302,793 B1 10/2001 Fertitta, III et al.
6,328,648 B1 12/2001 Walker et al.
6,330,427 B1 12/2001 Tabachnik
6,352,478 B1 3/2002 Gabai et al.
6,369,908 B1 4/2002 Frey et al.
6,371,375 B1 4/2002 Ackley et al.
6,375,578 B1 4/2002 Briggs
6,404,409 B1 6/2002 Solomon
6,409,379 B1 6/2002 Gabathuler et al.
6,414,589 B1 7/2002 Angott et al.
6,463,257 B1 10/2002 Wood
6,463,859 B1 10/2002 Ikezawa
6,482,067 B1 11/2002 Pickens
6,490,409 B1 12/2002 Walker
6,494,457 B1 12/2002 Conte et al.
6,509,217 B1 1/2003 Reddy
6,525,660 B1 2/2003 Surintrspanont
6,526,158 B1 * 2/2003 Goldberg ..... 382/115
6,551,188 B1 4/2003 Toyama et al.
6,589,120 B1 7/2003 Takahashi
6,626,728 B1 9/2003 Holt
6,632,142 B1 10/2003 Keith
6,634,949 B1 10/2003 Briggs et al.
6,682,074 B1 1/2004 Weston
6,709,336 B1 3/2004 Siegel et al.
6,746,334 B1 6/2004 Barney
6,761,637 B1 * 7/2004 Weston et al. ..... 463/42
2001/0034257 A1 10/2001 Weston et al.
2002/0032067 A1 3/2002 Barney
2002/0038267 A1 3/2002 Can et al.
2002/0052238 A1 5/2002 Muroi
2002/0058459 A1 5/2002 Holt
2002/0158751 A1 10/2002 Bormaster
2002/0193047 A1 12/2002 Weston
2003/0069077 A1 4/2003 Korienek
2003/0106455 A1 6/2003 Weston
2003/0144047 A1 7/2003 Sprogis
2003/0193572 A1 10/2003 Wilson et al.
2004/0033833 A1 2/2004 Briggs et al.
2004/0077423 A1 4/2004 Weston et al.
2004/0092311 A1 * 5/2004 Weston et al. ..... 463/42
2004/0198517 A1 10/2004 Briggs
2004/0204240 A1 10/2004 Barney

FOREIGN PATENT DOCUMENTS

WO WO 02/47013 6/2002
WO WO 03/043709 5/2003

OTHER PUBLICATIONS

Digital ID Cards The next generation of 'smart' cards will have more than a one-track mind. Wall Street Journal, Jun. 25, 2001.
"Raise High the 3D Roof Beam: Kids shape these PC games as they go along." By Anne Field, article as featured in Business Week 2001.
Tech Designers Rethink Toys: Make Them Fun/Toy Designers Use Technology in New Ways as Sector Matures. Wall Street Journal, Dec. 17, 2001.
"212 Series of Decoders" HT12D/HT12F by HOLTEK—Product Specification (Nov. 2002).
"212 Series Encoders" HT12A/HT12E by HOLTEK—Product Specification (Apr. 2000).
"Enchanted Spell-Casting Sorcerers Wand" by Ken Holt as featured on www.inventionconnection.com online advertisement (Dec. 2002).
"Micro Tilt Switch" D6B by Omron® Product Specification.
"Owl Magic Wand and Owl Magic Orb" Press Release by Emerald Forest Toys (Nov. 2001).
"Serial-in Parallel-out Shift Register" SN54/74LS164 by Motorola—Product Specification.
"The Magic Labs Conjure Wands" as featured on www.magic-lab.com Product Specification Dec. 2002.
"Tilt Switch" by Fuji & Co. as featured on www.fuji-piezo.com online advertisement May 2001.
"Toy Wand Manufacturer Selects MEMSIC Sensor: Magic Labs cuts costs with MEMSIC sensor" Press Release by MEMSIC, Inc. as featured on www.memsic.com May 2002.
PCT International Search Report and Written Opinion mailed Aug. 26, 2004, App. No. PCT/US04/08912, 10 pages.

* cited by examiner

HARVEST QUEST CONSOLE
"Simple, Repair & Bug Reader"
1. Push button to activate reader.
2A. Light lights up.
2B. Place card on reader for points.
2C. Read display for points.

INTERACTIVE WATER ATTRACTION AND QUEST GAME

RELATED APPLICATIONS

This application claims priority under 35 U.S.C. § 119(e) to U.S. provisional application Ser. No. 60/400,430, filed Aug. 1, 2002.

BACKGROUND OF THE INVENTION

1. Field of the Invention

The present invention relates to interactive attractions and games and, in particular, to an interactive water attraction utilizing electronically-identifiable objects or tags to provide a unique interactive water play experience.

2. Description of the Related Art

Water parks, theme parks, family entertainment centers and other similar facilities are well known for providing various water attractions for facilitating play and interaction among multiple play participants. A wide variety of commercially available interactive water attractions are known, such as disclosed and described in my U.S. Pat. No. 6,375,578 entitled "Two-way Interactive Water Slide" and my U.S. Pat. No. 5,820,471, entitled "Participatory Water Play System."

However, there is always a demand for more exciting and entertaining water play attractions and games that increase the learning and entertainment opportunities for children and stimulate creativity and imagination.

SUMMARY OF THE INVENTION

The invention provides a unique water play attraction, game system and method of game play wherein gaming is carried out within a themed water play attraction comprising an existing or specially configured entertainment water play facility and/or water play structure. The game utilizes electronically identifiable objects, such as colored balls, shaped objects, cards, bands, RFID-tagged objects and/or the like, to provide an interactive game play experience generally simulative of a computer adventure game experience. Play participants are challenged to work and cooperate with other play participants to find identified objects, clues and/or other information and to use the objects, clues and/or information to solve various puzzles or problems that present encumbrances inhibiting a players advancement in the game. Preferably, each play participant also possesses a unique RFID band, card or the like, that electronically identifies the play participant and enables the play system to award and track points or other rewards to successful play participants individually or working with other play participants as a team. Thus, play participants participate in a computer-orchestrated adventure game, while using a physical play space and physical objects to overcome both physical and mental challenges presented by the game.

In accordance with one embodiment the present invention provides a method and system of interactive game play carried out within a water park. The game includes a plurality of electronically distinguishable play objects and one or more consoles or stations adapted to distinguish the play objects electronically. The game challenges play participants to find and use identified objects in identified consoles.

In accordance with another embodiment the present invention provides a method game play wherein play participants participate in a computer driven adventure game as they float or swim around a lazy river or other swimming channel, and using physical and/or electronic objects capable of interacting electronically with the computer driven gaming system.

In accordance with another embodiment the present invention provides a modified computer game carried out by one or more play participants within a themed water-play structure using a computer interface comprising wireless ID tags worn by play participants and electronically identifiable play objects. Optional redemption coupons, tickets, prize and/or the like may be awarded to play participants as they successfully compete each task.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

Having thus summarized the general nature of the invention and its essential features and advantages, certain preferred embodiments and modifications thereof will become apparent to those skilled in the art from the detailed description herein having reference to the figures that follow, of which.

DETAILED DESCRIPTION OF THE PREFERRED EMBODIMENTS

Basic System and Framework

Figure 1:
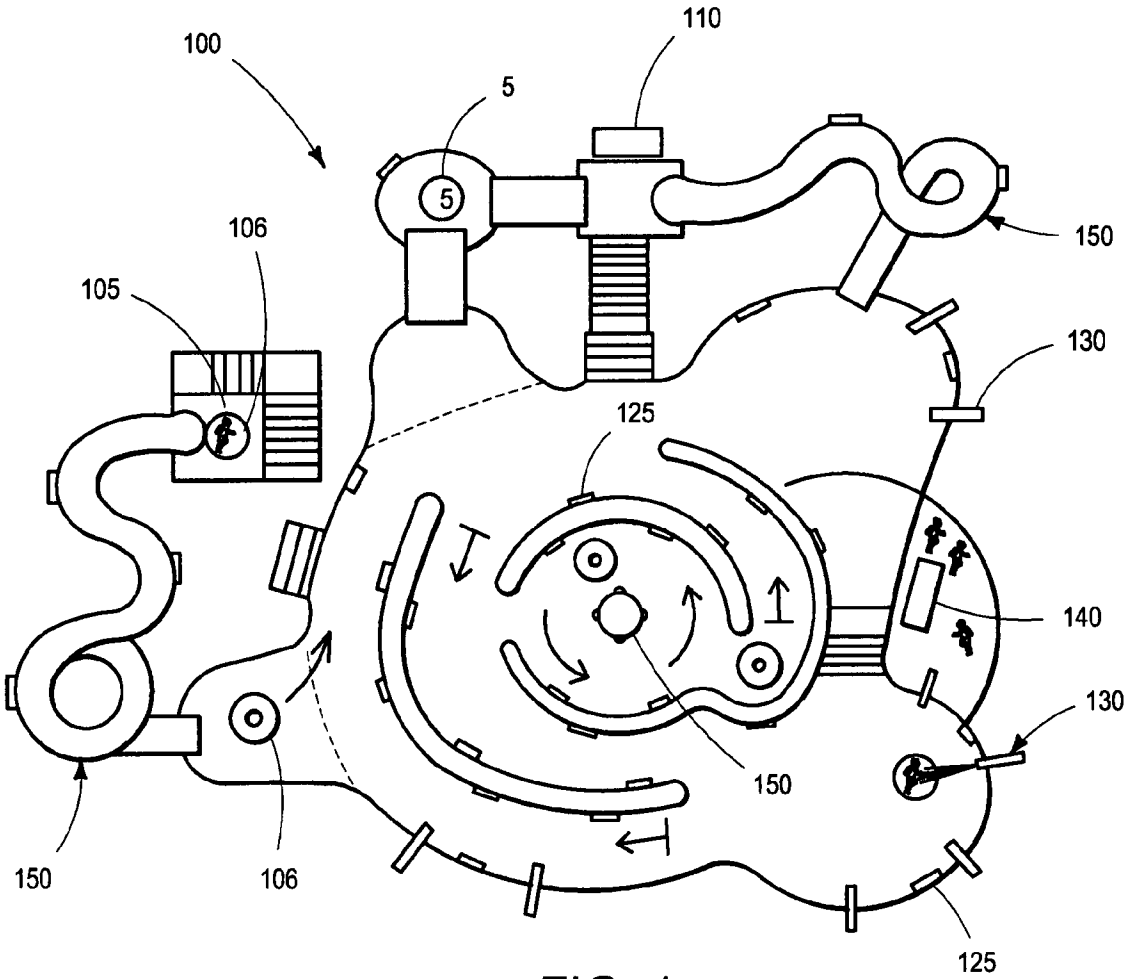
FIG. 1 is a schematic plan view of one embodiment of an RFID interactive water play attraction incorporating features and advantage in accordance with the present invention.

FIG. 1 illustrates one preferred embodiment of an interactive water play attraction 100 configured and adapted to facilitate an interactive game having features and advantages in accordance with the present invention. For ease of description and understanding the particular water attraction illustrated is laid out in one level. However, those skilled in the art will readily appreciate that such an attraction may also be constructed and laid out in multiple levels, as desired, including multiple play levels, rooms, and various themed slides, chutes, climbing nets, and/or other play devices or props to be enjoyed by multiple play participants. Within the play attraction 100, play participants 105 ride on inner tubes 106 and/or other float vehicles as they embark on a quest to find and use various electronically-identifiable objects to solve problems, find lost treasure and/or the like.

Preferably, each play participant 105 and/or group of participants is uniquely identified via an RFID tag, card, bracelet and/or the like (described later). Identification information, such as play participant name, age, group affiliation, etc. may be entered using a registration station 110 located adjacent the water attraction 100. A plurality of interactive consoles 125 are distributed throughout the structure 100. Each console is preferably equipped with an RFID reader adapted to electronically identify play participants via one or more wireless RFID tags or bands worn or possessed by play participants. Optional points, redemption coupons, tickets, prize and/or the like may be awarded to play participants as they successfully complete each task. These may be printed using a dispenser or the like and/or the may be recorded electronically via the RFID tag. Thus, as each play participant moves throughout the water attraction and interacts with various interactive devices comprising the game and distributed throughout the play attraction 100, the play system is able to track and identify relevant attributes of play each participant, such as points accumulated, levels achieved, special skills acquired, etc. Play participants 106 advance in the game by successfully completing various challenges presented throughout the water attraction and/or throughout the course of game play.

Points are tracked and displayed on a central score board 150. Scores may be reported directly to the score board by each console 125, such as via Ethernet or wireless communication. Alternatively, an intermediate point station 140 may be used to periodically collect and report points for each play participant 105 or group of play participants. In that case, play participants would present their band or RFID tags to the point station 140 to determine their points. The point station preferably incorporates an RFID reader, which reads the RFID tag and obtains and displays the points for each participant. This information is then provided to the score board 150 for display. Optionally, point information and other information may be communicated via internet to a central host and/or one or more other interactive soft-play game centers.

Earned points may be used to receive redemption tickets, prizes and/or other incentives. For example, the point station 140 could be configured to issue redemption tickets according to total points accumulated by each play participant. Play participants can then redeem the tickets for prizes, freebies, discounts or the like. Alternatively, the points stored on each RFID tag may be used to access and play associated games, such as video games and the like.

The water attraction 100 preferably comprises multiple chutes/slides 150 feeding riders into a meandering lazy river constructed using any one of an number of materials and construction techniques well known to those skilled in the art. The attraction 100 may be suitable for either outdoor or indoor use, as desired. Preferably, the Optionally, a suitable play media, such as foam or rubber balls/fish/ducks or similar objects, may be provided for use throughout the water attraction 100 to provide a tactile interactive play experience. Optionally, a number of water conduits or other transport means may be provided throughout the framework 102 for collecting and transporting play media to and from the various play areas in the water attraction 100. The conduits may be formed from plastic pipes, channels joined together using commercially available fittings, as is well known in the art. Conduits may also be formed from a wide variety of other suitable materials such as steel pipe, ceramic/clay pipe, or they may be formed as open channels and/or runners, as desired. Various participant-operated or "magically" actuated conveyors may also be employed to circulate various play media from one area of the attraction 100 to another, as desired.

Optionally, the water attraction 100 also preferably incorporates a number of conventional play elements, such as climbing nets, air bounce/trampolines, water cannons 130, balance beams, hanging bumper-bags, log crawl, tunnels, moon jumps, trolley slides, block walks swinging/web bridges, slides and/or the like. These provide entertaining physical challenges and allow play participants to safely negotiate their way through the various areas of the water attraction 100. Slides may be provided at the various locations in and around the water attraction 100 and may be straight, curved, or spiral-shaped, as desired. They may also be enclosed and tube-like or open and exposed to floating or flying play media, as desired. Alternatively, those skilled in the art will readily appreciate that the size, number, and location of the various slides 150 can be varied, as desired, while still enjoying the benefits and advantages of the present invention. Those skilled in the art will readily appreciate that a wide variety of other passive play elements, such as funny mirrors, rotating tunnels, trampolines, climbing bars, swings, etc. may all be used to create a desired play environment for carrying out the features and advantages as of the present invention as taught herein.

While a particular preferred play environment and water attraction 100 has been described, it will be readily apparent to those skilled in the art that a wide variety of other possible water play environments, play structures, entertainment centers and the like may be used to create an interactive environment within which the invention may be carried out. For instance, a suitable water attraction may be constructed substantially entirely of molded or contoured concrete, fiberglass or plastic, as desired. Alternatively, a suitable water attraction may be provided by retrofitting an existing water park attraction, pool or lazy river attraction.

Game Play

Game play begins at the introductory registration station 110. Here play participants 105 register to play the game, input relevant information about themselves, such as name, age, group affiliation. Play participants then proceed into the water attraction 100 and to the various game consoles 125. The game consoles 125 preferably challenge play participants to complete a specified task (e.g., find a hidden object (either floating or underwater) or clue, answer a multiple-choice question, push a button(s), jump over light beam sensor, or the like).

Before play participants can begin the game, the RF Tag Reader/Writer first reads the play participant's UPIN and/or UGIN and confirms the player's status. The console then prompts the play participant to complete a specified task. Once the interface senses that the requested task has been completed, the RF Tag Reader/Writer writes updated information to the play participant's RFID tag. This information may include, station number visited, updated number of points accumulated, error check bits/flags and/or various other information.

At any time during game play a play participant can visit one or more optional point stations 140 to determine his or her status in the game and the total points accumulated. The point station may comprise a simple RF Tag Reader and associated display and/or it may include a guest interface or other input device for more sophisticated functionality. Preferably, at least one point station 140 is disposed near the exit of the water attraction. Here players can verify and log their final point tally. The final point station preferably includes a RF Tag Reader/Writer. Various software in the final point station may be used to log and verify the final recorded score and communicate such information to the main score board 150. Optionally, once the score has been logged and verified the final point station may "reset" the play participant's RFID tag so that the play participant can turn in the RFID tag at the exit gate to be used by another play participant.

Game Consoles

Figure 2:
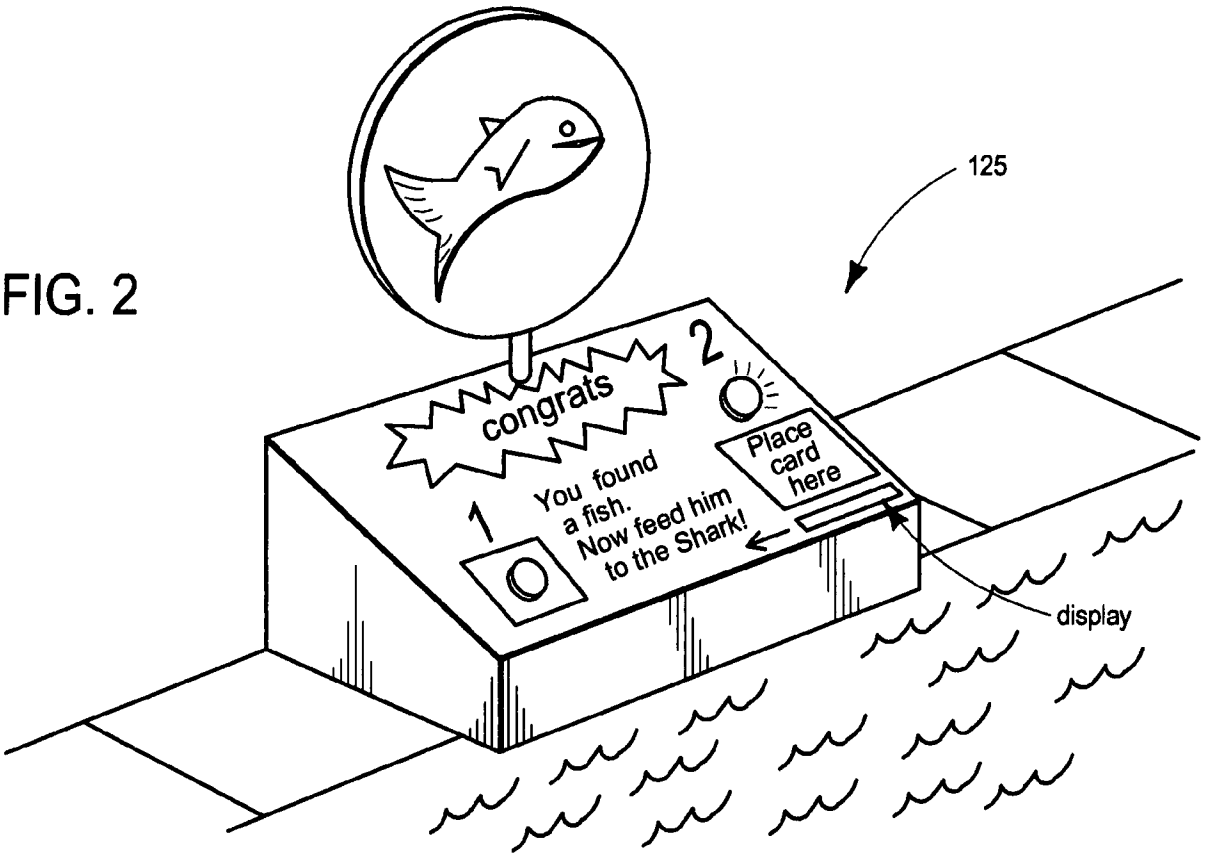
FIG. 2 is a perspective view of one embodiment of an interactive game console having features and advantages in accordance with the present invention.
Figure 3:
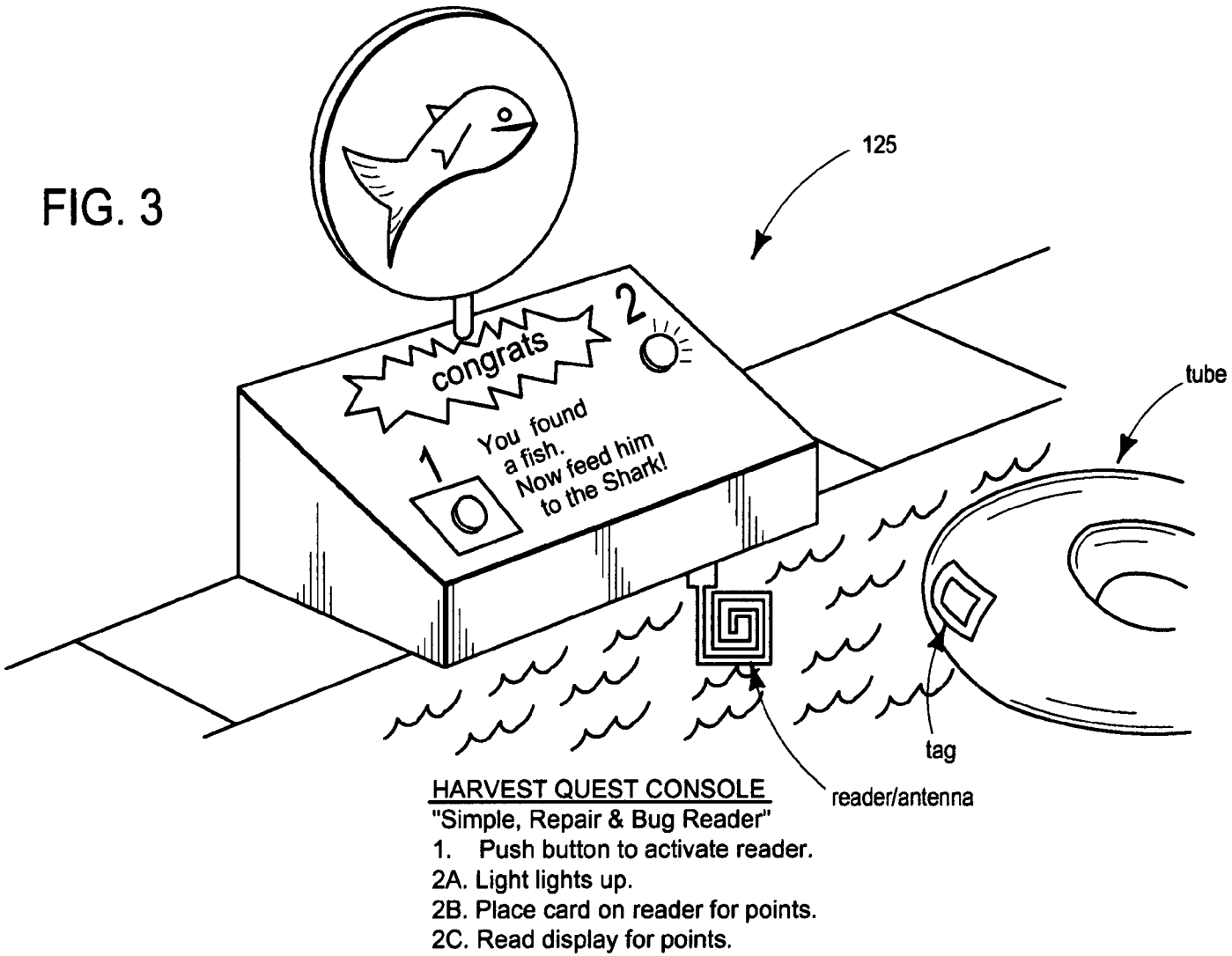
FIG. 3 is a perspective view of an alternative embodiment of an interactive game console having features and advantages in accordance with the present invention.

In the preferred embodiment illustrated and described above, multiple interactive quest consoles 125 are arranged throughout the attraction 100. One preferred embodiment of a game console 125 is illustrated in FIG. 2. Each game console 125 preferably contains RFID readers/writers adapted to read and/or write to the RFID tags or bracelets worn by play participants 105. Game consoles may be out in the open or hidden, as desired. Play participants 105 find each console and use the RFID tags/bands to receive points and/or complete a game. Preferably, game play follows a story line that play participants learn as they play. Play participants may learn clues and gather objects or tools (real or imaginary/electronic) that enable them to progress through the game, solve a mystery, or complete a quest or treasure hunt. Preferably, the various consoles 125 are arranged and programmed such that they must be visited and operated in a particular order to complete the game and earn the maximum number of points. For example, certain consoles may only be activated if the play participant has already visited and received points or information from other consoles 105 within (or outside) the water attraction 100. The game play may be similar to a typical interactive computer adventure game. FIG. 3 illustrates an alternative preferred embodiment of a game console 125. In this case, the antenna or "pick up" portion of the RFID readers/writer is disposed outside the console so as to more-easily communicate with one or more RFID tags affixed directly to each inner tube 106.

RFID Tags and Readers

As indicated above, each play participant 105 within the water attraction 100 preferably receives an electronic identification device such as an RFID tag or transponder ("tag"). The tag allows play participants to electronically interact with the various quest consoles to achieve desired goals or produce desired effects within the play environment. Play participants preferably collect points or earn additional levels or ranks for each interactive console they successfully complete. In this manner, play participants 105 may compete with one another to see who can score more points and/or achieve the highest levels in the quest game.

At its most basic level, RFID provides a wireless link to uniquely identify objects or people. It is sometimes called dedicated short range communication (DSRC). RFID systems include electronic devices called transponders or tags, and reader electronics to communicate with the tags. These systems communicate via radio signals that carry data either unidirectionally (read only) or, more preferably, bi-directionally (read/write). One suitable RFI) transponder is the 134.2 kHz/123.2 kHz, 23 mm Glass Transponder available from Texas Instruments, Inc. (http://www.tiris.com, Product No. RI-TRP-WRHP).

Figure 4A:
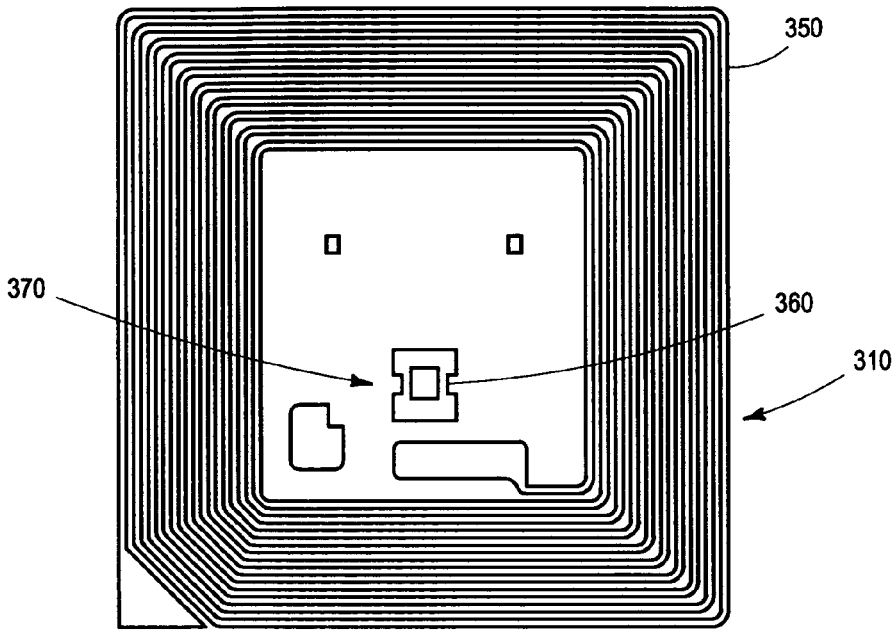
FIG. 4A is a detail plan view of one embodiment of an RFID tag device for use in accordance with one preferred embodiment of an interactive water play structure and game having features and advantages in accordance with the present invention.

FIG. 4A is a detailed schematic view of one embodiment of an RFID tag device 310 for use with one preferred embodiment of a quest game having features and advantages of the present invention. The tag 310 in the preferred embodiment illustrated preferably comprises a radio frequency tag pre-programmed with a unique person identifier number ("UPIN") or quest object identification number (UOIN). Other stored information (either pre-programmed or programmed later) may include, for example, the play participant's name, age, rank or level achieved, total points accumulated, tasks completed, facilities visited, etc. The tag 310 generally comprises a spiral wound antenna 350, a radio frequency transmitter chip 360 and various electrical leads and terminals 370 connecting the chip 360 to the antenna 350.

The tag may be a passive tag 310 or battery-powered, as expedience and costs dictate. Preferably, the tag 310 is passive (requires no batteries) so that it is inexpensive to purchase and maintain. Such tags and various associated readers and other accessories are commercially available in a wide variety of configurations, sizes and read ranges. RFID tags having a read range of between about 10 cm to about 100 cm are particularly preferred, although shorter or longer read ranges may also be acceptable. The particular tag 310 illustrated is the 13.56 mHz tag sold under the brand name Taggit™ available from Texas Instruments, Inc. (http://www.tiris.com, Product No. RI-103-110A). The tag 310 has a useful read/write range of about 25 cm and contains 256-bits of on-board memory arranged in 8×32-bit blocks which may be programmed (written) and read by a suitably configured read/write device. If a longer read/write range (e.g., 1–100 meters) and/or more memory (e.g., 1–100 Mb) is desired, optional battery-powered tags may be used instead, such as the AXCESS active RFID network system available from AXCESS, Inc. and/or various other RF-based asset and people tracking applications known to those skilled in the art.

Figure 4B:
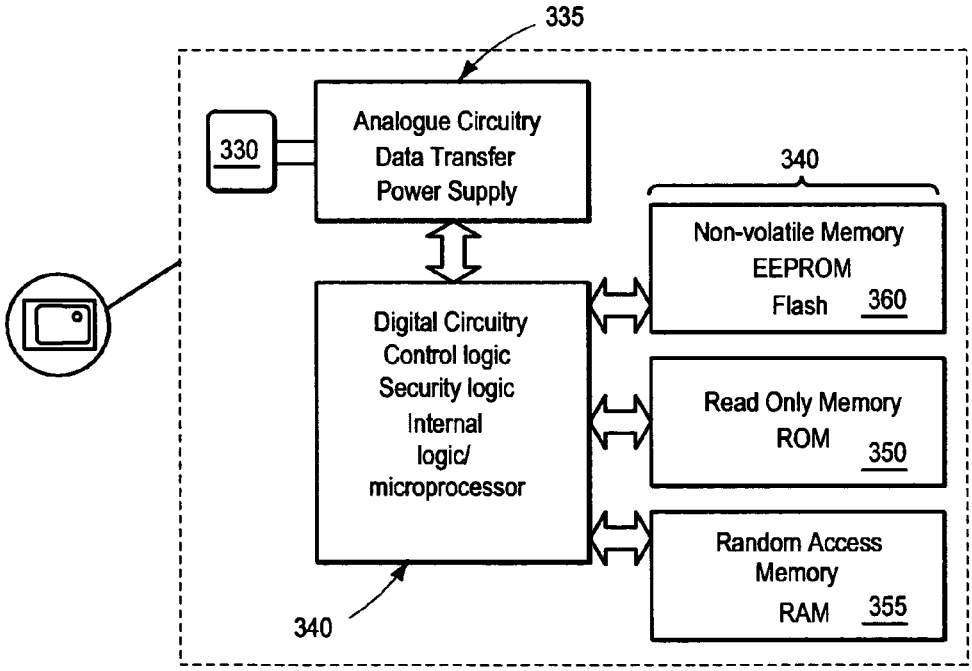
FIG. 4B is a schematic circuit diagram of one embodiment of an RFID tag device, illustrating the basic organization and function of the electronic circuitry comprising the RFID tag device of FIG. 4A for use in accordance with the present invention.

FIG. 4B is a simplified block diagram illustrating the basic organization and function of the electronic circuitry comprising the radio frequency transmitter chip 360 of the RFID tag device 310 of FIG. 4A. The chip 360 basically comprises a central processor 430, Analogue Circuitry 435, Digital Circuitry 440 and on-board memory 445. On-board memory 445 is divided into read-only memory (ROM) 450, random access memory (RAM) 455 and non-volatile programmable memory 460, which is available for data storage. The ROM-based memory 450 is used to accommodate security data and the tag operating system instructions which, in conjunction with the processor 430 and processing logic deals with the internal "house-keeping" functions such as response delay timing, data flow control and power supply switching. The RAM-based memory 455 facilitates temporary data storage during transponder interrogation and response. The non-volatile programmable memory 460 may take various forms, electrically erasable programmable read only memory (EEPROM) being typical. It is used to store the transponder data and is preferably non-volatile to ensure that the data is retained when the device is in its quiescent or power-saving "sleep" state. Various data buffers or further memory components (not shown), may be provided to temporarily hold incoming data following demodulation and outgoing data for modulation and interface with the transponder antenna 350. Analog Circuitry 335 provides the facility to direct and accommodate the interrogation field energy for powering purposes in passive transponders and triggering of the transponder response. Analog Circuitry also provides the facility to accept the programming or "write" data modulated signal and to perform the necessary demodulation and data transfer processes. Digital Circuitry 440 provides certain control logic, security logic and internal microprocessor logic required to operate central processor 430.

Advantageously, the UPIN stored on each tag 310 may be used to wirelessly identify and track individual play participants 105 within a play facility or park. Optionally, each tag 310 may also include a unique group identifier number or "UGIN" which may be used to match one or more play participants to a defined group or team. If desired, the tag 310 may be covered with an adhesive paper label (not shown) for surface adhesion to a quest object, clothes, or any other tag bearing surface. More preferably, the tag 310 may be molded and/or embedded into a relatively stiff plastic sheet substrate and/or transponder cylinder which holds and supports the tag 310. Optionally, the sheet substrate, transponder or other support structure may take on any other fanciful shape, as desired. The resulting structures may be inserted into and/or affixed to the various quest objects, and/or they may be worn externally by play participants (e.g., as a bracelet, necklace, key chain trinket, sticker, name badge, etc.).

In operation, various RFID reader (and/or reader/writer) devices are provided and may be distributed throughout the water attraction 100. These readers are able to read the information stored on each tag 310 when the associated person or object is brought into suitable proximity of the reader (1–100 cm). Advantageously, because radio waves can easily penetrate solid objects, such as plastic and the like, the tag 310 can be mounted internally within a cavity of the quest object, thereby providing an internal communication and information storage means for each quest object. Tags can also be worn close to the body, such as around a person's wrist. Thus, the UPIN, UOIN and UGIN information can be conveniently read and easily communicated to a quest console, computer monitor, interactive game control system, display system or other tracking, recording or displaying device for purposes of identifying, logging and creating a record of each play participant's experience. Additional information (e.g., unique personality traits, special powers, skill levels, etc.) can also be easily stored on each tag, thus providing further character development and interactive gaming possibilities.

Figure 5A:
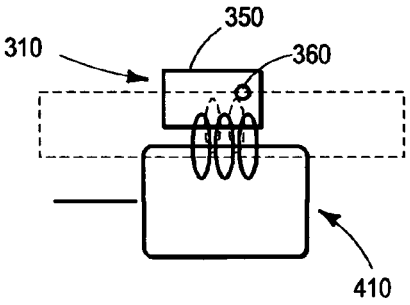
FIGS. 5A and 5B are schematic diagrams illustrating typical operation of the RFID tag device of FIG. 4.
Figure 5B:
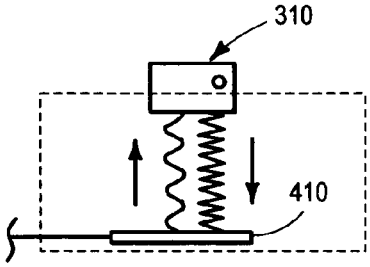
Figure 6A:
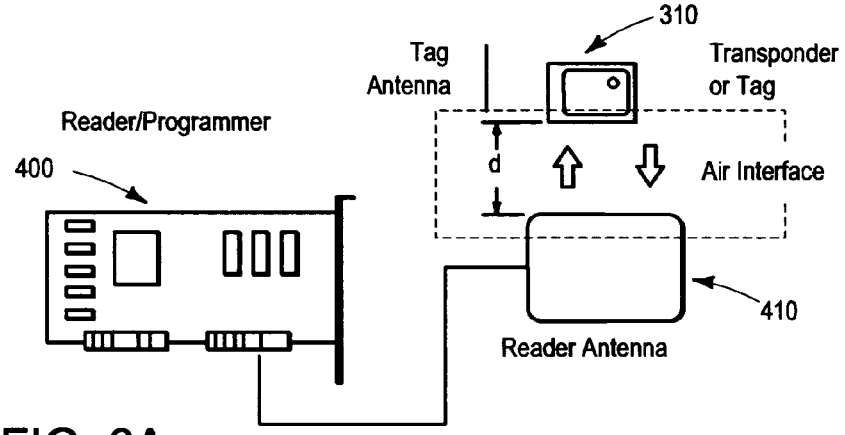
FIGS. 6A and 6B are a simplified schematic diagrams of an RFID read/write system for use with the RFID tag device of FIG. 4 and having features and advantages in accordance with the present invention.
Figure 6B:
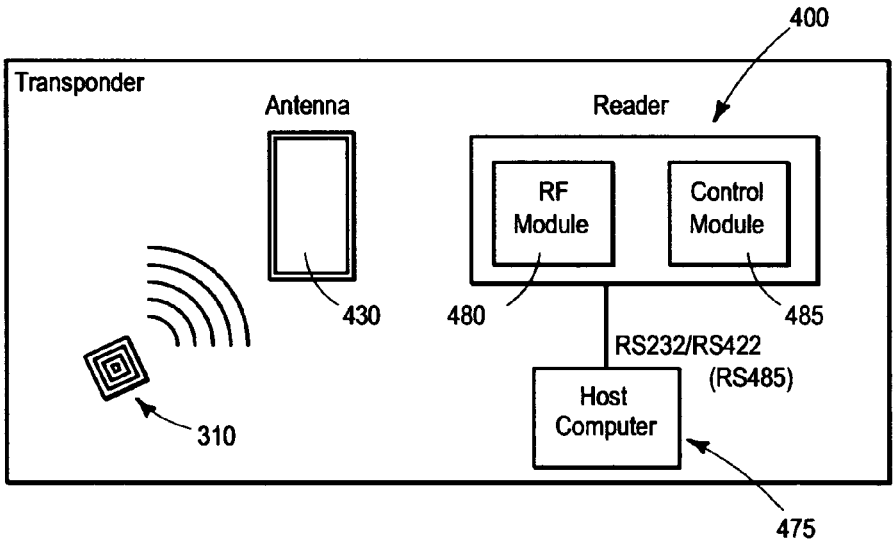

FIGS. 5 and 6 are simplified schematic illustrations of tag and reader operation. The tag 310 is initially activated by a radio frequency signal broadcast by an antenna 410 of an adjacent reader or activation device 400. The signal impresses a voltage upon the antenna 350 by inductive coupling which is then used to power the chip 360 (see, e.g., FIG. 4A). When activated, the chip 360 transmits via radio frequency a unique identification number preferably corresponding to the UPIN, UOIN and/or UGIN described above (see, e.g., FIG. 4A and associated discussion). The signal may be transmitted either by inductive coupling or, more preferably, by propagation coupling over a distance "d" determined by the range of the tag/reader combination. This signal is then received and processed by the associated reader 400, as described above, and then communicated to a host computer 475. If desired, the RFID tag or transponder 310 may also be configured for read/write communications with an associated reader/writer. Thus, the unique tag identifier number (UPIN, UGIN or UOIN) and any other stored information can be read, changed or other information maybe added.

As indicated above, communication of data between a tag and a reader is by wireless communication. As a result, transmitting such data is possibly subject to the vagaries and influences of the media or channels through which the data has to pass, including the air interface. Noise, interference and distortion are potential sources of data corruption that may arise. Thus, those skilled in the art will appreciate that a certain degree of care should be taken in the placement and orientation of the various readers 400 so as to minimize the probability of such data transmission errors. Preferably, the readers are placed at least 30–60 cm away from any metal objects, power lines or other potential interference sources. Those skilled in the art will also recognize that the write range of the tag/reader combination is typically somewhat less (~10–15% less) than the read range "d" and, thus, this should also be taken into account in determining optimal placement and positioning of each reader device 400.

Typical RFID data communication is asynchronous or unsynchronized in nature and, thus, particular attention should be given in considering the form in which the data is to be communicated. Structuring the bit stream to accommodate these needs, such as via a channel encoding scheme, is preferred in order to provide reliable system performance. Various suitable channel encoding schemes, such as amplitude shift keying (ASK), frequency shift keying (FSK), phase shift keying (PSK) and spread spectrum modulation (SSM), are well know to those skilled in the art and will not be further discussed herein. The choice of carrier wave frequency is also important in determining data transfer rates. Generally speaking the higher the frequency the higher the data transfer or throughput rates that can be achieved. This is intimately linked to bandwidth or range available within the frequency spectrum for the communication process. Preferably, the channel bandwidth is selected to be at least twice the bit rate required for the particular application.

The water-based quest game in accordance with the above-described example provides a challenging, computer-orchestrated interactive gaming experience within a physical play space using electronically-identifiable physical objects as an interactive play medium. The game provides kids with the intellectual challenge and excitement of a computer adventure game, but with tangible interactives, physical challenges, and social interaction.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. An interactive water attraction for entertaining one or more play participants comprising:

a pool or other body of water;

a plurality of electronically identifiable objects, cards, bands or tags disposed in, on, or around said pool or other body of water;

one or more game consoles distributed in, on, or around said pool or other body of water and being adapted to sense or read one or more of said plurality of electronically identifiable objects, cards, bands or tags;

said one or more game consoles being pre-programmed to play one or more games using said electronically identifiable objects, cards, bands or tags;

whereby play participants are challenged to find identified objects, clues or other information and/or to use the objects, clues or other information to solve various puzzles or problems that present encumbrances to advancement in the game.

2. The interactive water attraction of claim 1 wherein said pool or other body of water comprises a swimming pool and one or more associated water slides.

3. The interactive water attraction of claim 1 wherein said pool or other body of water comprises a lazy river water ride.

4. The interactive water attraction of claim 1 wherein said pool or other body of water comprises a lazy river water ride.

5. The interactive water attraction of claim 1 wherein at least one of said plurality of electronically identifiable objects comprises an RFID tag.

6. The interactive water attraction of claim 5 wherein said RFID tag is molded or embedded into a plastic substrate.

7. The interactive water attraction of claim 1 wherein at least one of said plurality of electronically identifiable objects comprises a passive RFID tag having no battery.

8. The interactive water attraction of claim 1 wherein each of said plurality of electronically identifiable objects comprises an RFID tag and wherein each said RFID tag contains an associated unique UOIN for uniquely identifying each of said plurality of electronically identifiable objects.

9. The interactive water attraction of claim 1 wherein at least one of said one or more game consoles comprises an RFID reader adapted to electronically sense or read one or more of said plurality of electronically identifiable objects, cards, bands or tags.

10. The interactive water attraction of claim 1 wherein at least one of said one or more game consoles comprises an RFID reader/writer adapted to electronically sense or read one or more of said plurality of electronically identifiable objects, cards, bands or tags and to write information for storage therein.

11. The interactive water attraction of claim 1 wherein at least one of said pre-programmed games comrprises a treasure hunt game wherein at least one object of said game is to find one or more of said plurality of electronically identifiable objects, cards, bands or tags.

12. The interactive water attraction of claim 1 wherein at lest one of said pre-programmed games comrprises a quest game wherein at least one object of said game is to find one or more of said plurality of electronically identifiable objects, cards, bands or tags and to use said one or more electronically identifiable objects, cards, bands or tags to solve a mystery or complete a puzzle or quest.

13. The interactive water attraction of claim 1 further comprising electronically identifiable tags adapted to be worn or carried by each play particpant for purposes of identifying and tracking play participants playing said one or more games.

14. The interactive water attraction of claim 13 wherein said electronically identifiable tags worn or carried by each play participant comprise RFID tags adapted to be worn as wristbands.

15. The interactive water attraction of claim 14 wherein each said electronically identifiable RFID tags contains an associated unique UPIN for uniquely identifying each play particpant.

16. An interactive water attraction for entertaining one or more play participants comprising:

a pool or other body of water;

a plurality of electronically identifiable bands or tags adapted to be worn by each said play particpant for uniquely identifying and tracking of each said play particpant;

one or more game consoles distributed in, on, or around said pool or other body of water and being adapted to sense or read one or more of said plurality of electronically identifiable bands or tags;

said one or more game consoles being pre-programmed to play one or more games using said electronically identifiable bands or tags;

whereby play participants are challenged to play a game, solve puzzles or overcome other challenges that present encumbrances to advancement in the game.

17. The interactive water attraction of claim 16 wherein said pool or other body of water comprises a swimming pool and one or more associated water slides.

18. The interactive water attraction of claim 16 wherein said pool or other body of water comprises a lazy river water ride.

19. The interactive water attraction of claim 16 wherein said pool or other body of water comprises a lazy river water ride.

20. The interactive water attraction of claim 16 wherein at least one of said plurality of electronically identifiable bands or tags comprises an RFID tag.

21. The interactive water attraction of claim 16 wherein at least one of said plurality of electronically identifiable tags or bands comprises a passive RFID tag.

22. The interactive water attraction of claim 16 wherein each of said plurality of electronically identifiable tags or bands comprises an RFID tag and wherein each said RFID tag contains an associated unique UPIN for uniquely identifying each said play participant.

23. The interactive water attraction of claim 16 wherein at least one of said one or more game consoles comprises an RFID reader adapted to electronically sense or read one or more of said plurality of electronically identifiable bands or tags.

24. The interactive water attraction of claim 16 wherein at least one of said one or more game consoles comprises an RFID reader/writer adapted to electronically sense or read one or more of said plurality of electronically identifiable bands or tags and to write information for storage therein.

25. The interactive water attraction of claim 16 wherein at least one of said pre-programmed games comprises a treasure hunt game wherein at least one object of said game is to find one or more of a plurality of electronically identifiable objects, cards, bands or tags.

26. The interactive water attraction of claim 16 wherein at lest one of said pre-programmed games comprises a quest game wherein at least one object of said game is to find one or more of a plurality of electronically identifiable objects, cards, bands or tags and to use said one or more electronically identifiable objects, cards, bands or tags to solve a mystery or complete a puzzle or quest.

27. A method for interactive water play carried out in, on or around a pool or other body of water, said method comprising the following steps:

providing a plurality of electronically identifiable objects, cards, bands or tags in, on, or around said pool or other body of water;

mounting one or more game consoles at different locations in or on or around said pool or other body of water, said game consoles being adapted to sense or read one or more of said plurality of electronically identifiable objects, cards, bands or tags;

programming said one or more game consoles to play one or more games using said electronically identifiable objects, cards, bands or tags;

whereby play participants are challenged to find identified objects, clues or other information and/or to use the objects, clues or other information to solve various puzzles or problems that present encumbrances to advancement in the game.

* * * * *

UNITED STATES PATENT AND TRADEMARK OFFICE

CERTIFICATE OF CORRECTION

PATENT NO. : 7,029,400 B2
APPLICATION NO. : 10/632556
DATED : April 18, 2006
INVENTOR(S) : Rick A. Briggs It is certified that error appears in the above-identified patent and that said Letters Patent is hereby corrected as shown below:

At column 6, line 10, please delete "RFI)" and insert --RFID--, therefore.

At column 8, line 11, please delete "maybe" and insert --may be--, therefore.

At column 9, line 25, please cancel claim 4.

At column 9, line 52, in claim 11, please delete "comrprises" and insert --comprises--, therefore.

At column 9, line 57, in claim 12, please delete "lest" and insert --least--, therefore.

At column 9, line 57, in claim 12, please delete "comrprises" and insert --comprises--, therefore.

At column 9, line 65, in claim 13, please delete "particpant" and insert --participant--, therefore.

At column 10, line 8, in claim 15, please delete "particpant" and insert --participant--, therefore.

At column 10, line 13, in claim 16, please delete "particpant" and insert --participant--, therefore.

At column 10, line 15, in Claim 16, please delete "particpant" and insert --participant--, therefore.

At column 10, line 32, please cancel claim 19.

Signed and Sealed this

Twenty-third Day of March, 2010

David J. Kappos

David J. Kappos
*Director of the United States Patent and Trademark Office*